US009527191B2

(12) United States Patent
Chen

(10) Patent No.: US 9,527,191 B2
(45) Date of Patent: Dec. 27, 2016

(54) LOCKING PLIERS WITH EXTENDIBLE JAWS

(71) Applicant: Chung Li Chen, Taichung (TW)

(72) Inventor: Chung Li Chen, Taichung (TW)

( * ) Notice: Subject to any disclaimer, the term of this patent is extended or adjusted under 35 U.S.C. 154(b) by 304 days.

(21) Appl. No.: 14/536,666

(22) Filed: Nov. 9, 2014

(65) Prior Publication Data

US 2015/0059537 A1 Mar. 5, 2015

(51) Int. Cl.
*B25B 7/14* (2006.01)
*B25B 7/18* (2006.01)
*B25B 7/04* (2006.01)

(52) U.S. Cl.
CPC . *B25B 7/14* (2013.01); *B25B 7/04* (2013.01); *B25B 7/18* (2013.01)

(58) Field of Classification Search
CPC ..... B25B 7/14; B25B 7/04; B25B 7/18; B25B 5/04; B25B 5/16; B25B 5/166; B25B 7/08; B25B 7/16
See application file for complete search history.

(56) References Cited

U.S. PATENT DOCUMENTS 8,286,954 B2 * 10/2012 Zheng ..... B25B 5/06 269/188
2015/0008631 A1 * 1/2015 Liu ..... B25B 7/04 269/164

* cited by examiner

*Primary Examiner* — David B Thomas

(57) ABSTRACT

A locking pliers is provided with pivotably secured first and second handles; a link and quick release assembly having both ends pivotably secured to the first and second handles respectively; first and second jaw carriers each including a casing member, a jaw pivotaby secured to the casing member, and an arm having one end secured to the casing member and the other end moveably mounted in either handle; a spring member disposed in either handle for clamping the arm.

1 Claim, 6 Drawing Sheets

LOCKING PLIERS WITH EXTENDIBLE JAWS

BACKGROUND OF THE INVENTION

1. Field of the Invention

The invention relates to locking pliers and more particularly to a pair of locking pliers having two arms at one ends of two handles respectively, the arms being adapted to extend to draw two jaws away from each other or retract to draw the jaws toward each other.

2. Description of Related Art

A conventional locking pliers is shown in FIG. 1 and comprises two handles 11, a through hole 12 in one handle 11 and facing one jaw (not numbered), a second hole 14 intersecting the through hole 12, a lever 15 disposed in the second hole 14, an arm 13 having one end secured to one jaw and the other end passing through the through hole 12 and intersecting the second hole 14 to retractably dispose in one handle 11, and a lock lever 15 partially disposed in the second hole 14 with the arm 13 passing through, and a torsion spring 18 put on the arm 13 and biased between the lock lever 15 and the surface of the second hole 14.

However, the conventional pair of locking pliers is not reliable in operation due to the structural deficiencies. Thus, the need for improvement still exists.

SUMMARY OF THE INVENTION

It is therefore one object of the invention to provide a locking pliers comprising a first handle; a second handle pivotably secured to the first handle at a spring biased pivot; a link and quick release assembly having both ends pivotably secured to the first and second handles respectively; a first jaw carrier including a first casing member, a first jaw pivotably secured to the first casing member, and a first arm having a first end secured to the first casing member and a second end moveably mounted in the first handle; a first spring member disposed in the first handle for clamping the first arm; a second jaw carrier including a second casing member, a second jaw pivotaby secured to the second casing member, and a second arm having a first end secured to the second casing member and a second end moveably mounted in the second handle; and a second spring member disposed in the second handle for clamping the second arm; wherein the first arm is configured to pull out of the first handle a first predetermined distance, and wherein the second arm is configured to pull out of the second handle a second predetermined distance The above and other objects, features and advantages of the invention will become apparent from the following detailed description taken with the accompanying drawings.

DETAILED DESCRIPTION OF THE INVENTION

Figure 1:
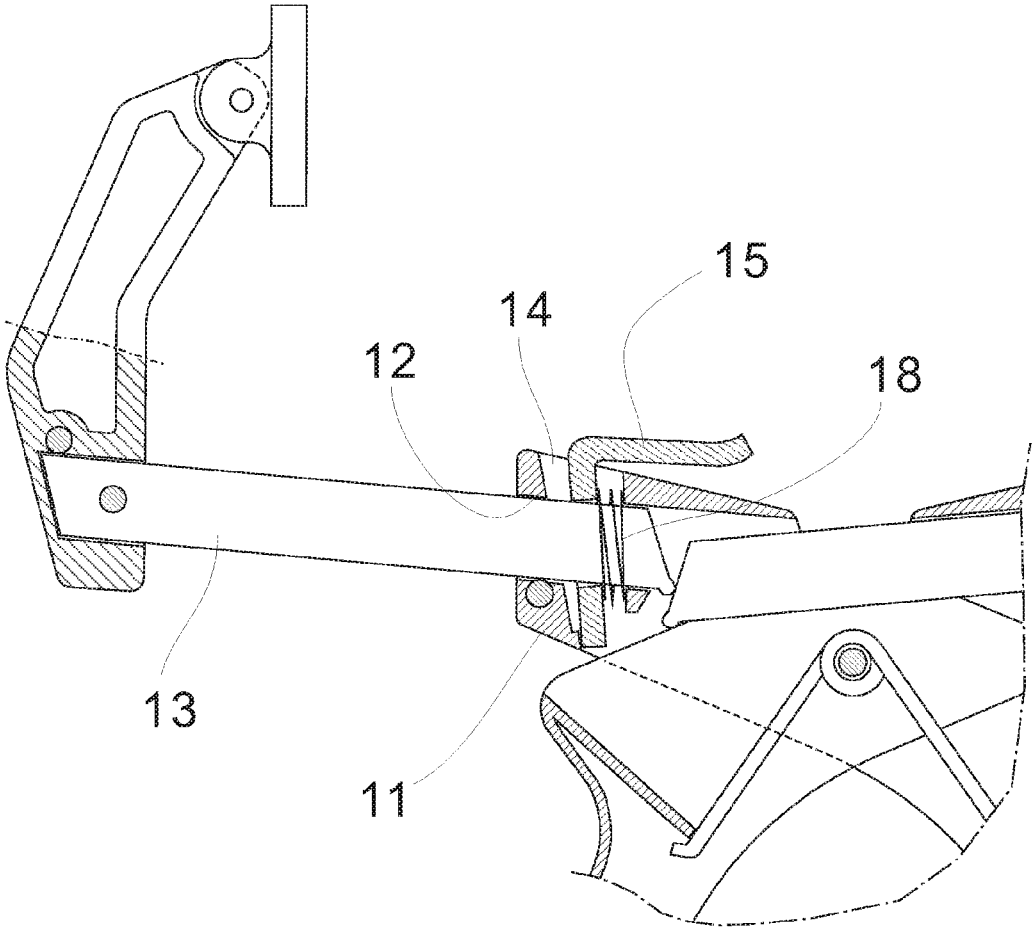
FIG. 1 PRIOR ART
FIG. 1 is a fragmentary in part section view of a conventional pair of locking pliers.
Figure 2:
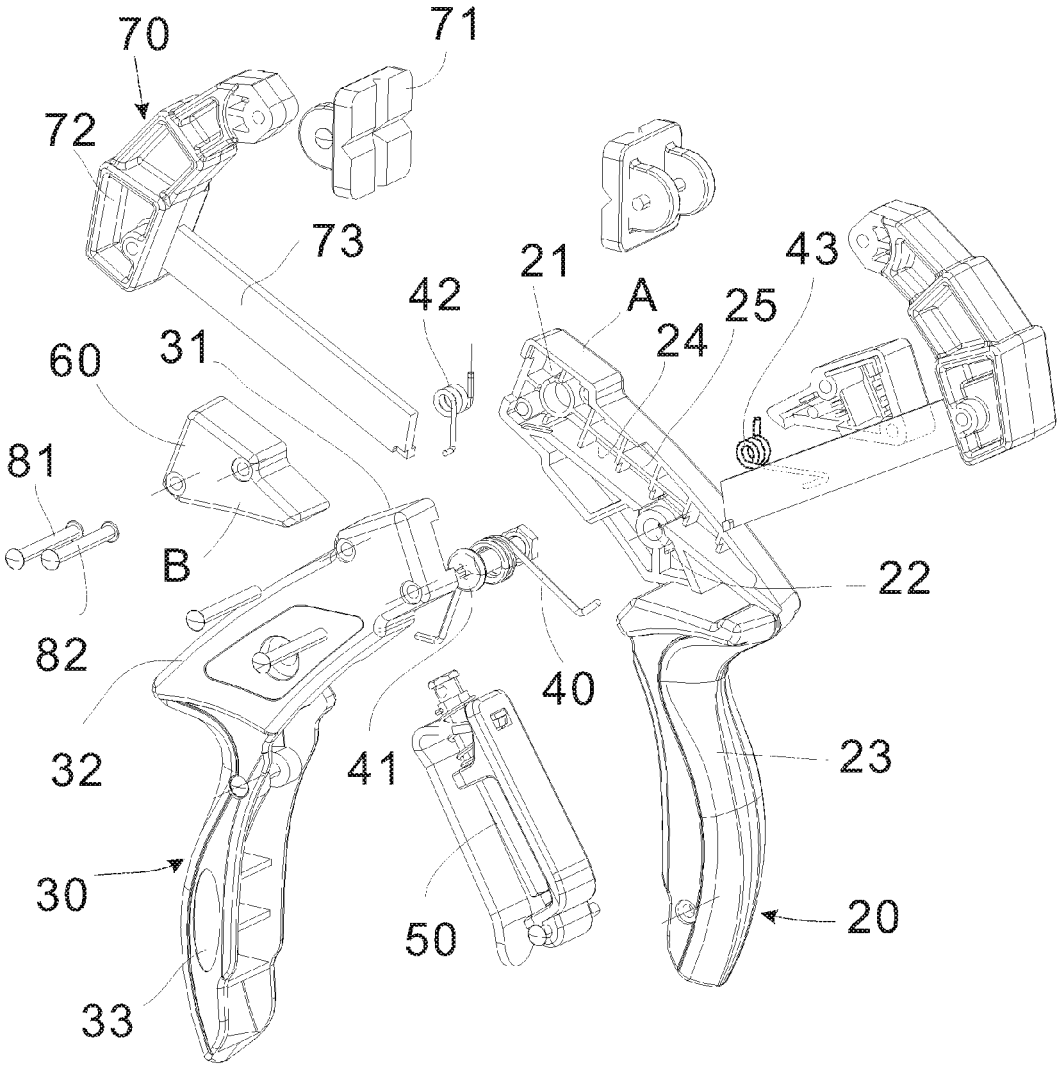
FIG. 2 is an exploded view of a pair of locking pliers according to the invention.
Figure 3:
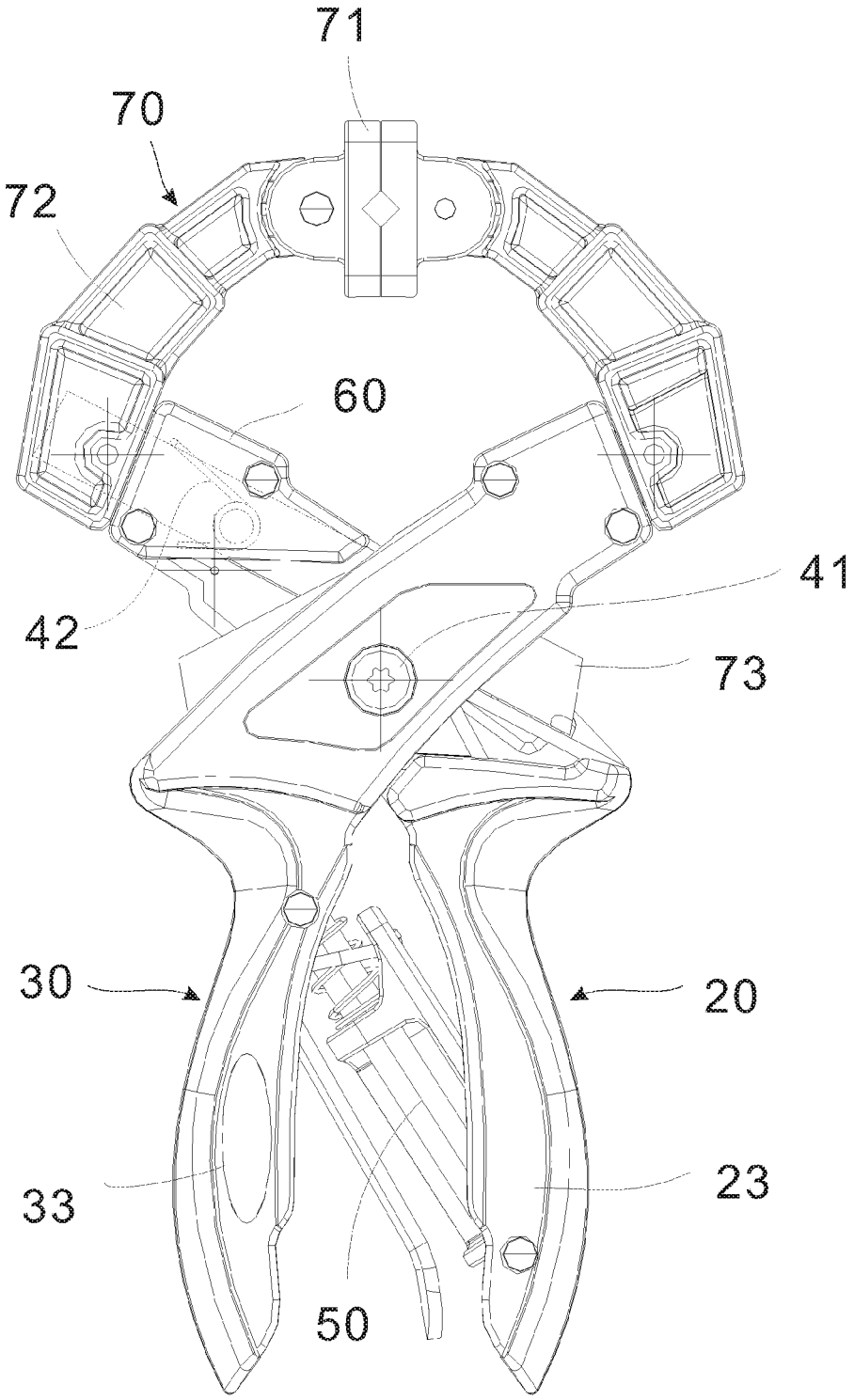
FIG. 3 is a side elevation of the assemble locking pliers shown in FIG. 2, the jaws being engaged.
Figure 4:
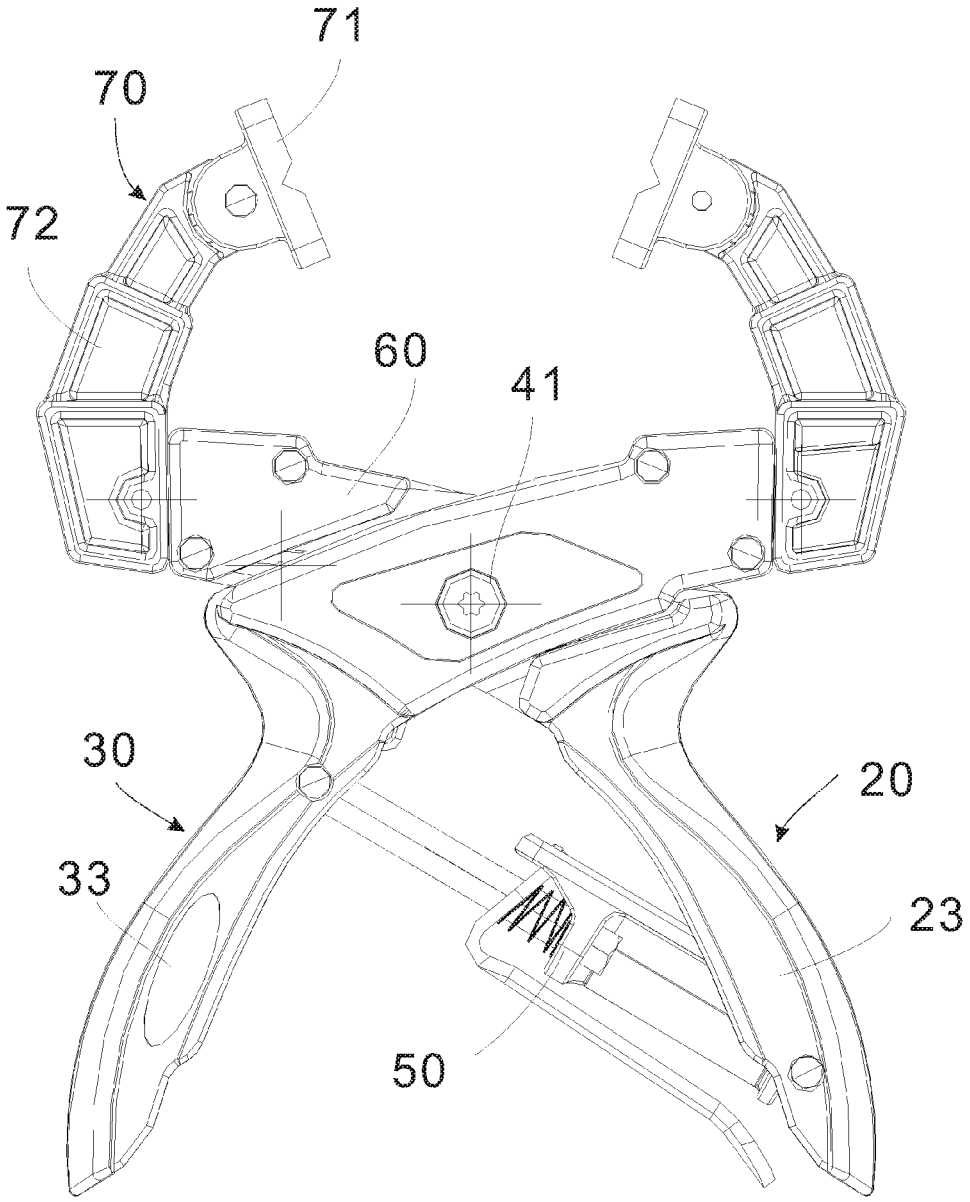
FIG. 4 is a view similar to FIG. 3, the jaws being disengaged in a ready to clamp position.
Figure 5:
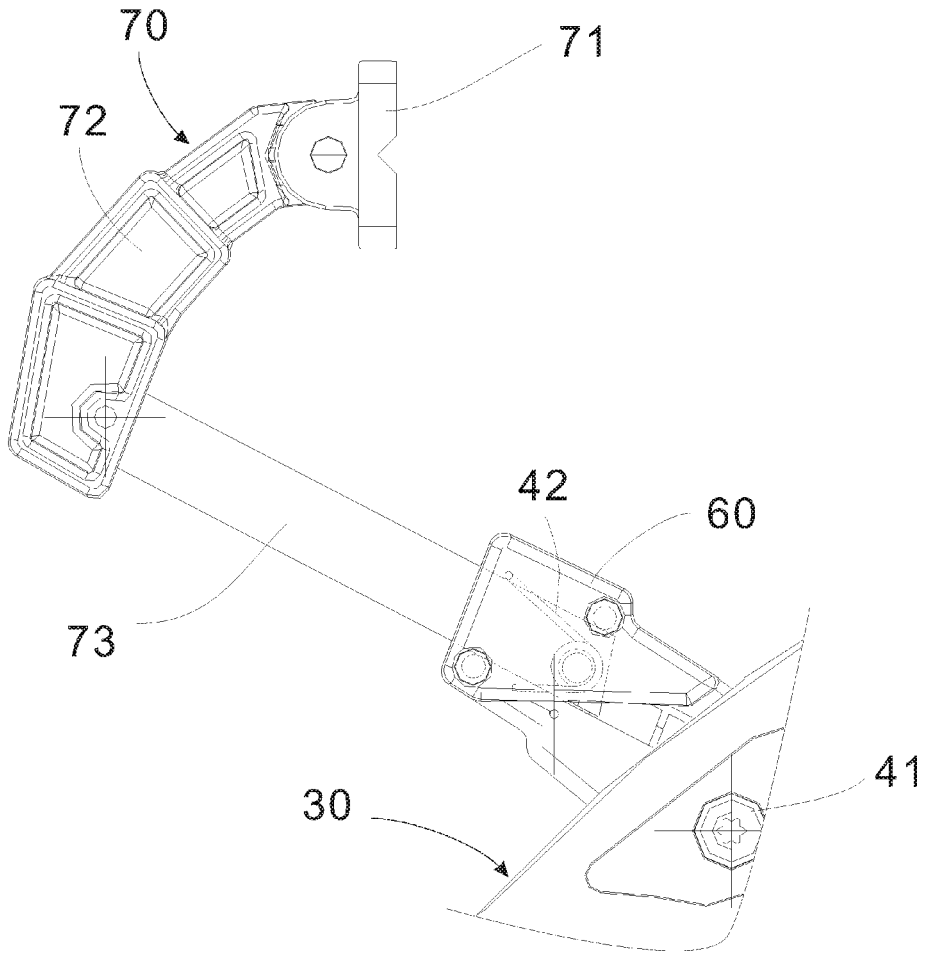
FIG. 5 is a fragmentary view of FIG. 4 showing the arm being extended.

Referring to FIGS. 2 to 6, a pair of locking pliers in accordance with the invention comprises the following components as discussed in detail below.

A first handle 20 and a second handle 30 pivotably joined at a pivot 41. A torsion spring 41 is put on the pivot 41 and has both ends anchored in the first and second handles 20, 30 respectively. The first handle 20 is bent to form a first section 22 joining the pivot 41, a second section 23 adapted to be grasped by the hand, and a forward portion 21 as housing A. The second handle 30 is bent to form a first section 32 joining the pivot 41, a second section 33 adapted to be grasped by the hand, and a forward portion 31. Two shell members B are provided and each has a cover 60. On cover 60 is secured to the housing A by using two pins 81, 82. The other cover 60 is secured to the forward portion 31 by using two pins. One torsion spring 42 is mounted in one cover 60 and the other torsion spring 43 is mounted in the other cover 60.

Within the housing A there are provided a groove 24 and a plurality of ribs 25 for enhancing structural strength. A link and quick release assembly 50 has both ends pivotably secured to the first and second handles 20, 30 respectively. Two jaw carriers 70 each comprises a casing member 72, a jaw 71 pivotaby secured to the casing member 72, and an arm 73 having one end secured to the casing member 72 and the other end moveably mounted in the housing A or the forward portion 31. The arm 73 is clamped by the torsion spring 42 or 43.

Figure 6:
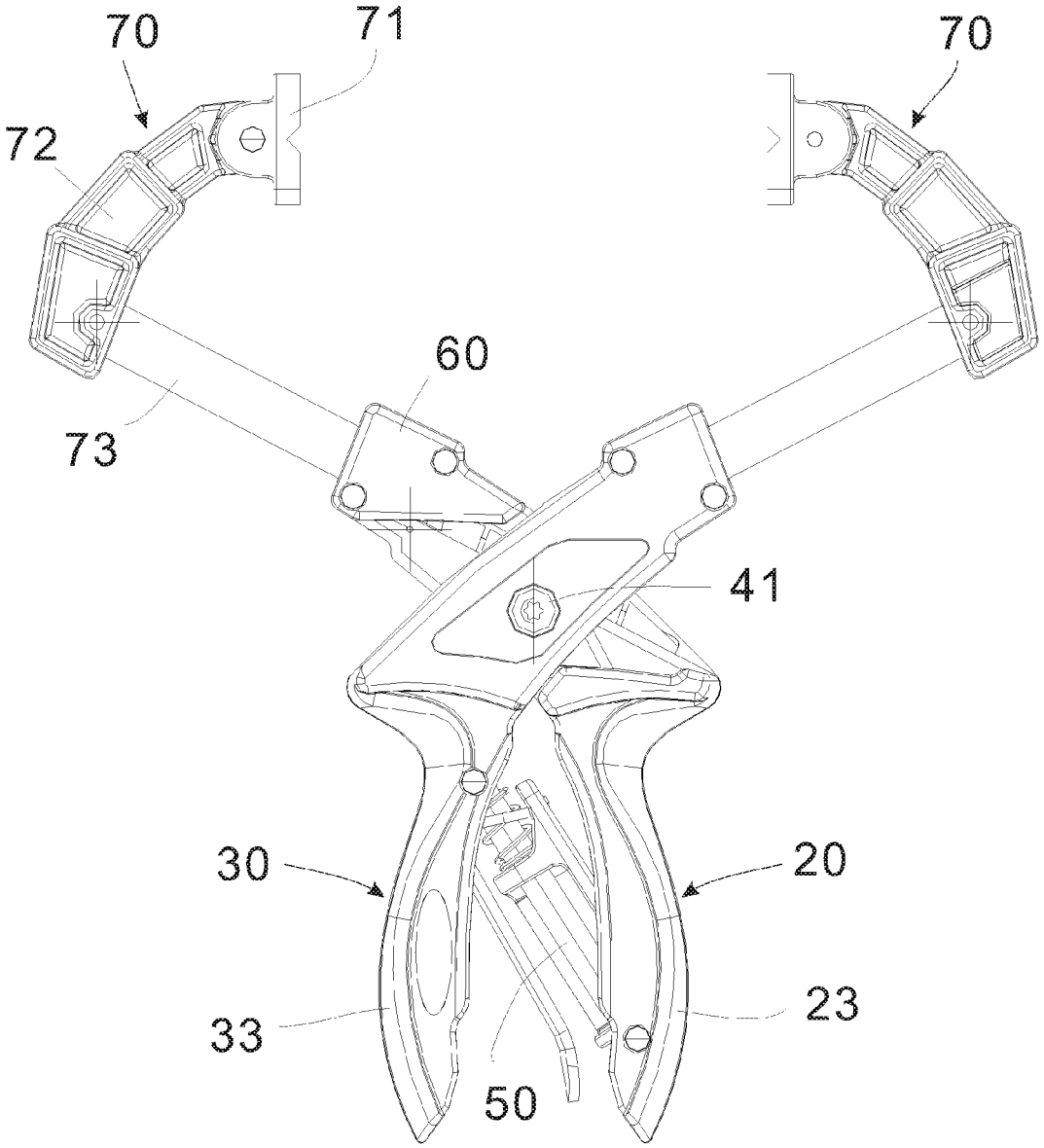
FIG. 6 is a view similar to FIG. 3 showing the arms being fully extended.

For adjusting distance between one jaw 71 and the other jaw 71, a user may pull one arm 73 away from the other arm 73 (see FIG. 5) or pull the arms 73 away from each other (see FIG. 6).

While the invention has been described in terms of preferred embodiments, those skilled in the art will recognize that the invention can be practiced with modifications within the spirit and scope of the appended claims.

What is claimed is:

1. A locking pliers comprising:

a first handle;

a second handle pivotably secured to the first handle at a spring biased pivot;

a link and quick release assembly having both ends pivotably secured to the first and second handles respectively;

a first jaw carrier including a first casing member, a first jaw pivotaby secured to the first casing member, and a first arm having a first end secured to the first casing member and a second end moveably mounted in the first handle;

a first spring member disposed in the first handle for clamping the first arm;

a second jaw carrier including a second casing member, a second jaw pivotaby secured to the second casing member, and a second arm having a first end secured to the second casing member and a second end moveably mounted in the second handle; and a second spring member disposed in the second handle for clamping the second arm;

wherein the first arm is configured to pull out of the first handle a first predetermined distance, and wherein the second arm is configured to pull out of the second handle a second predetermined distance.

* * * * *